United States Patent [19]

Farcasiu et al.

[11] 4,127,475

[45] Nov. 28, 1978

[54] PROCESS FOR THE ISOLATION OF CHEMICALS FROM PROCESSED COALS

[75] Inventors: Malvina Farcasiu, Princeton; Darrell D. Whitehurst, Titusville, both of N.J.

[73] Assignee: Electric Power Research Institute, Inc., Palo Alto, Calif.

[21] Appl. No.: 768,443

[22] Filed: Feb. 14, 1977

[30] Foreign Application Priority Data

Jan. 13, 1976 [CA] Canada ..... 243479

[51] Int. Cl.[2] ..... C10G 25/00

[52] U.S. Cl. ..... 208/310 R; 208/8; 210/31 C

[58] Field of Search ..... 208/8, 310 R; 210/31 C

[56] References Cited

U.S. PATENT DOCUMENTS

| | | | |
|---|---|---|---|
| 2,776,250 | 1/1957 | Capell et al. | 208/310 R |
| 2,776,297 | 10/1956 | Neuworth | 260/627 R |
| 2,930,821 | 3/1960 | Schwoegler et al. | 208/310 R |

OTHER PUBLICATIONS

Mair et al., "Journal of Research," National Bureau of Standards, vol. 32 (Apr. 1944) pp. 165 to 183.

"Chromatographic Adsorption and Silica Gel," The Davison Chemical Corporation, Baltimore, Md. pp. 1 to 5 (1946).

*Primary Examiner*—Herbert Levine

*Attorney, Agent, or Firm*—Townsend and Townsend

[57] ABSTRACT

Processed coal such as solvent refined coal are subjected to multistage liquid chromatographic fractionation. There is employed a succession of eluants of progressively varying properties, this succession having the effect of removing from the substrate a corresponding succession of sharply defined, chemically differentiated product groups each of value as an industrial raw material. An installation for practising the invention on a continuous basis is described.

28 Claims, 1 Drawing Figure

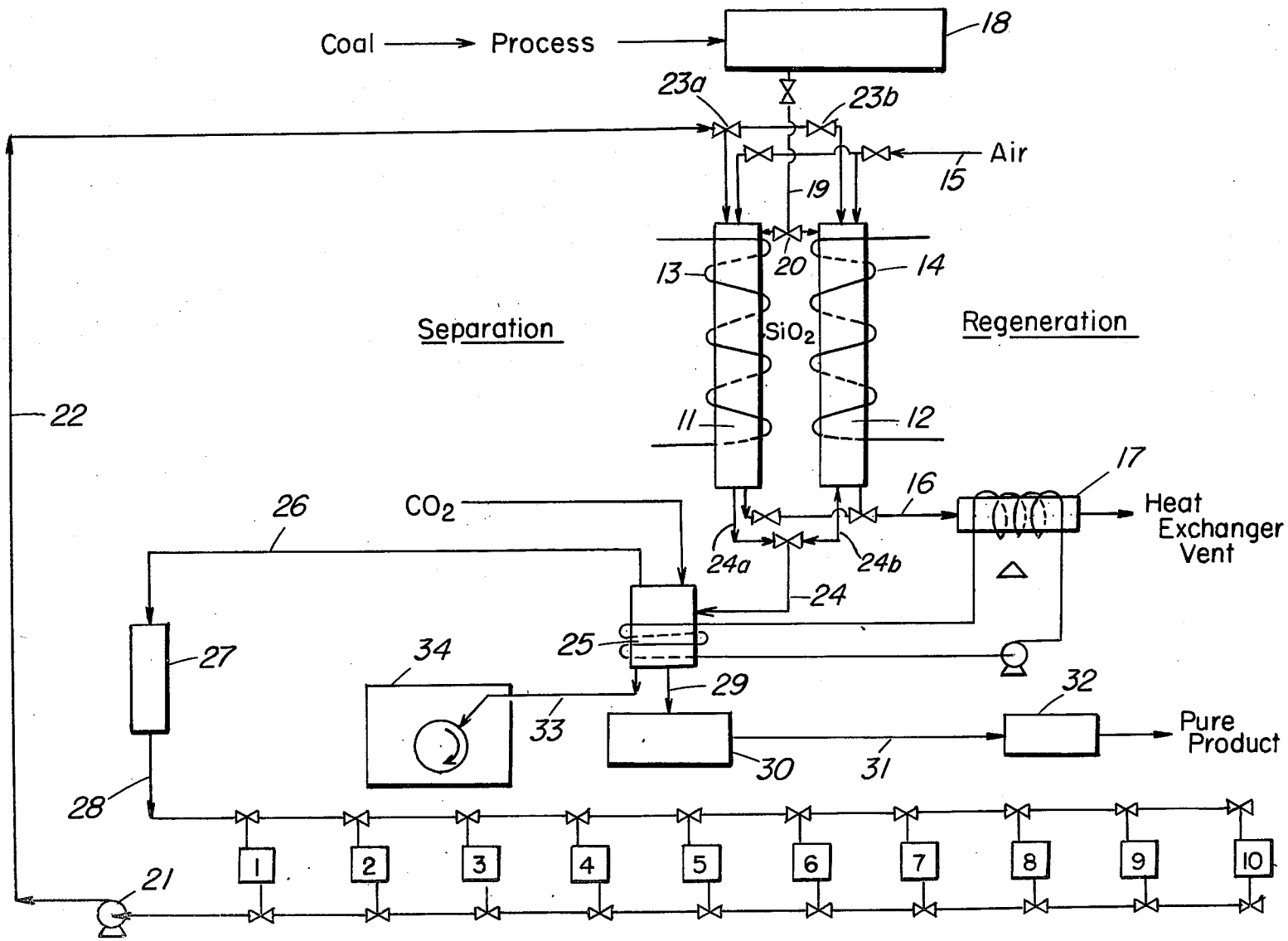
Coal
Process
18
Air
15
23b
23a
19
20
14
13
12
11
$SiO_2$
Regeneration
Separation
16
17
Heat Exchanger Vent
24b
24a
24
25
$CO_2$
26
27
28
21
22
29
30
31
32
Pure Product
33
34
1
2
3
4
5
6
7
8
9
10

PROCESS FOR THE ISOLATION OF CHEMICALS FROM PROCESSED COALS

BACKGROUND OF THE INVENTION

It has long been known that fuels and chemicals can be obtained from coal. With the exception of the World War II period, however, when the European countries' petroleum supplies were interrupted, commercial exploitation of this knowledge has not been intensive: the lower cost of petroleum and the more highly developed technology for isolating industrially useful materials from it render coal a poor competitor with petroleum.

The recent large increase in the price of petroleum is tending to eliminate cost of raw material as a deterrent to the use of coal as source of fuels and chemicals: and, accordingly, focussing attention on improved techniques for recovering such materials from it.

Since coal cannot be employed for such purposes in the as-mined condition it must be converted to an intermediate to which recovery processes can be applied. The intermediate favoured in current industrial installations is tar, frequently obtained as by-product in the manufacture of smokeless solid fuel by low-temperature carbonisation of coal. The tar, however, represents a low proportion of the mass of the starting coal, and if the primary product of its production, namely smokeless fuel, is not of economic interest the resolution of the tar loses its attractiveness. Nevertheless, in the installations referred to the primary product has been of interest and the overall process, culminating with NaOH extraction of the phenols from the tar, has been economical. There have been proposals for the furthr refining of tar fractions, such as the removal of tar bases from the acids by sorption on a column of silica-alumina cracking catalyst described in U.S. Pat. No. 2,766,297.

The present invention is directed to a technique by which a far greater proportion of the original coal mass is resolved into useful products. To this end it employs as starting material such derivatives as solvent-refined coal which are obtained by methods involving the minimum possible carbonisation of compounds present in the coal. In addition, the resolution achieved is considerably sharper than have been previously achieved, thus increasing the quality as well as the quantity of product.

SUMMARY OF THE INVENTION

According to the present invention a method for resolving, into chemically differentiated fractions, such derivatives of naturally occurring carbonaceous material as by virtue of their solvent-extractive or thermal derivation contain at least about 10% by weight asphaltenes and are substantially free of inorganic material, comprises:

(A) Introducing into an active silica gel chromatographic column, an eluant; successively eluting from said column fractions of said eluant by sequential use of pure or mixed solvents, generally of increasing polarity, going from hydrocarbons, to halocarbons to amines as the major components to obtain solutions in the respective eluants of at least four chemically differentiated fractions; and recovering each fraction from its solution in the eluant. Preferably the silica gel is partially deactivated at an intermediate eluant.

(B) Introducing into a silica gel chromatographic column from about 5 to 20 percent, by weight of the silica in the column, of said derivative;

(C) Successively eluting from the column fractions of said derivative by the sequential use, as eluant, of (i) A mixture of about 95 to 75 parts by weight of a saturate selected from petroleum ether, udex raffinate, alkylate, and pure hydrocarbons having 5 to 10 carbon atoms and a straight-chain, branched-chain or cyclic structure; with about 5 to 25 parts of weight of an aromatic selected from benzene, toluene, xylenes and mixtures of aromatics derived from a reforming, coking or cracking process (ii) Chloroform;

(iii) a mixture of about 98 to 80 percent by weight of chloroform with 2 to 20 percent by weight of an acyclic aliphatic ether having less than 10 carbon atoms; and (iv) An aromatic tertiary amine or a derivative thereof having a substituent selected from aliphatic hydrocarbon having 1 to 2 carbon atoms and cycloaliphatic having less than 7 carbon atoms; to obtain solutions in the respective eluants of four chemically differentiated fractions; and (D) Recovering each fraction from its solution in its eluant.

DESCRIPTION OF SPECIFIC EMBODIMENTS

As we have stated a preferred derivative is solvent-refined coal, obtained for instance by heating a slurry of coal in recycled solvent under hydrogen pressure to obtain substantially complete dissolution of organic matter. Other potential derivatives are those known as H-coal, obtained by feeding a slurry of coal in oil to an ebullating bed of hydrogenation catalyst in a reactor maintained under hydrogen pressure; and synthoil, obtained by feeding a similar slurry through a fixed bed of hydrogenation catalyst in the presence of turbulently flowing hydrogen. A considerable variety of such process is currently being devised, with the object of obtaining from coal a derivative which is capable of replacing crude petroleum as source of industrial organics: all such processes furnish feeds which may be resolved according to the invention. In some cases it can be useful to perform a preliminary solvent extraction of the derivative before subjecting it to the chromatography: in this manner one can avoid introducing into the column feed components which are either less valuable or more difficult to elute.

The invention is, however, not restricted to resolution of mixtures derived from coal. Naturally occurring carbonaceous material such as is found in tar sands and shale may be processed to eliminate inorganic matter by methods analogous to those applied to coal as aforesaid to yield derivatives which may be effectually subjected to the method of the present invention. Even those extremely hydrogen-deficient byproducts of standard petroleum-refining processes, such as residual oils, may be subjected to the method of the invention: the only requirement of feeds to the method is that they be substantially free of inorganic matter and contain at least 10% by weight, preferably at least 50% by weight, of asphaltenes.

Our invention is specific to the use of a silica-gel-packed chromatographic column since its mildly acidic properties are favourable to the separation we seek to achieve, namely separation into useful fractions of a whole solubilised carbonaceous material rather than a mere extract thereof such as a benzene-, pyridine or pentane-soluble fraction. Thus, prior art sorption processes have employed alumina as sorbent for resolution of certain of such extracts; but alumina cannot be used as sorbent for "whole coal" liquids because it irreversibly sorbs the highly functional pyridine-soluble benzene-insoluble fraction. Similarly, acidic and basic ion exchange resins are not useable for resolution of "whole coal" liquids since retention upon them of desired components of such liquids is non-quantitative, as a result either of chemical alteration of sorbed material, inefficiency of sorption, or irremovability.

The silica gel which we employ is of a particle size conventional for chromatographic applications, namely about 0.05 to 2 mm in diameter, preferably about 0.02 to 1.0 mm.

According to a feature of the invention which will be more fully developed hereinafter it should contain, at the start of operations, about 4 weight percent of water present as chemically bonded water of hydration: even in its broadest aspect, however, the invention contemplates removal of this water by one of the eluants, and where regeneration of the sorbent is practised it must therefore be rehydrated to the prescribed extent before re-use. The quantity of feed introduced into the gel column at the start of operation varies, on a weight basis, from about 5 to about 20 percent of the quantity of silica. In more practical terms, processing of 5 Kg of feed requires from 50 to 2001.of sorbent, depending on the specific characteristics of the feed.

The crux of the invention lies in the nature of the solvents employed to elute fractions of the feed from the column and the order in which these solvents are employed in the sequence of elutions. We have identified a total of ten classes of solvent a member of each of which will sharply elute from the column a useful fraction of the feed, each fraction comprising a plurality of related compounds and being chemically differentiated from all other fractions. We stress, however, that it is not only the nature of these solvent classes which confers significance upon them but also the order in which they are used. Thus, although it is not necessary to carry out ten elutions, using a member of every class, in order to achieve the benefits of the invention, those benefits will not be obtained unless (referring to the sequence set out below) each succeeding solvent used as eluant is selected from a class higher-numbered than the class from which the solvent used for the preceding elution was selected.

The classes are:

Class 1:

a saturate selected from petroleum ether, udex raffinate, alkylate, and pure hydrocarbons having 5 to 10 carbon atoms and a straight-chain, branched-chain or cyclic structure.

Class 2:

a mixture of about 95 to 75 parts by weight of a saturate selected from petroleum ether, udex raffinate, alkylate, and pure hydrocarbons having 5 to 10 carbon atoms and a straight-chain, branched-chain or cyclic structure; with about 5 to 25 parts by weight of an aromatic selected from benzene, toluene, xylene and mixtures of aromatics derived from a reforming, coking or cracking process.

Class 3:

Chloroform

Class 4:

A mixture of about 98 to 80 percent by weight of chloroform with 2 to 20 percent by weight of an acyclic aliphatic ether having less than 10 carbon atoms.

Class 5:

A mixture of about 98 to 80 parts by weight of an acyclic aliphatic ether having less than 10 carbon atoms with about 2 to 20 parts by weight of an aliphatic alcohol containing from 1 to 4 carbon atoms.

Class 6:

An aliphatic alcohol containing 1 to 4 carbon atoms.

Class 7:

A mixture of about 98 to 85 parts by weight of chloroform with about 2 to 15 parts of weight of an aliphatic alcohol containing 1 to 4 carbon atoms.

Class 8:

A mixture of 100 to 85 parts by weight of a material selected from cyclic aliphatic ethers, tetrahydrofuran, dioxane and any of the foregoing bearing an aliphatic hydrocarbon substituent containing 1 to 4 carbon atoms with about 0 to 15 parts by weight of an aliphatic alcohol containing 1 to 4 carbon atoms.

Class 9:

An aromatic tertiary amine or a derivative thereof having a substituent selected from aliphatic hydrocarbon having 1 to 2 carbon atoms and cycloaliphatic having less than 7 carbon atoms.

Class 10:

A mixture of about 95 to 85 parts by weight of the amine or derivative of class 9 with about 5 to 15 parts by weight of water.

The products, or fractions of feed, eluted by each of these classes of solvent differ functionally from one another and, therefore, in their applications. In Table 1 below we summarize their characterization and principal uses, the enumeration of the fractions corresponding to that of the solvent classes by which they are sequentially eluted. The proportion of feed which each fraction constitutes varies, of course, with the nature of the feed and the manner of its derivation, and the values furnished in the Table are therefore merely general indications.

TABLE I

| Classical Description | Fraction No. | Major Components | Uses | Proportion Of Feed (% Wt.) |
|---|---|---|---|---|
| Oils | 1 | Saturates (cyclic or acylic) | Diesel or jet fuel, fuel oils. | 0.5 to 2.5 |
| Oils | 2 | Aromatics, mainly $C_{13}$ - $C_{18}$ | Diesel or jet fuel, fuel oils, but including also thermally stable coolants and moderators. | 5 to 14 |
| Oils: asphaltenes | 3 | Polar aromatics, mainly non-basic N-containing but also O- and S-containing. | Thermally stable coolant and moderators: road tar additives, components of binder pitch. | 10 to 25 |
| Asphaltenes | 4 | Monophenols | Disinfectants, insecticides, wood preservatives, dyestuffs, pharmaceuticals, plastics, resins, antioxidants. | 3 to 30 |
| Asphaltenes: | | | | |

TABLE I-continued

| Classical Description | Fraction No. | Major Components | Uses | Proportion Of Feed (% Wt.) |
|---|---|---|---|---|
| Multifunctionals | 5 | Basis N-heterocyclics and diphenols | Same as for Fraction 4. | 10 to 30 |
| Multifunctionals | 6 | Highly functional compounds (>10% Wt heteroatoms) | Wood preservatives, asphalt binders. | 3 to 10 |
| Multifunctionals | 7 | Polyphenols | As Fraction 6, plus electrode coke. | 3 to 10 |
| Multifunctionals | 8 | As Fractions 6 and 7, but increasing O and increasingly basic N | As Fraction 7. | 7.5 to 20 |
| Multifunctionals | 9 | As Fraction 8 | As Fraction 8. | 10 to 15 |
| Multifunctional | 10 | As Fraction 9 | As Fraction 9. | 0.5 to 5 |

Therefore, in carrying out the subject elutions, the first fraction or fractions are obtained by using one or more hydrocarbon solvents of increasing polarity, the next fractions are obtained by using chloroform and, oxygenated solvents i.e. oxy-ethers and alkanols, either individually or as admixtures, of generaly increasing polarity, followed by tertiary amines, by themselves and then in combination with water. In admixtures of solvents, generally less than about 20 weight percent of the minor component will be employed. Preferably, at an intermediate stage of chromatographing, the silica gel is partially deactivated.

There is one further characteristic of the aforementioned sequence of solvent classes which determines the nature of the invention; namely that a solvent from any given class will elute from the column not only its corresponding fraction but also any fraction or lower number which has not previously been eluted. To take an example, Fractions 6 to 9 (as appears from Table 1) have at least one application in common: elutions with solvents from classes 6 to 8 can therefore be omitted and Fractions 6 to 9 obtained as a mixture by a single elution with a class 9 solvent. Similarly, Fraction 1 often constitutes a small proportion of total feed and can frequently be omitted where its presence in admixture with Fraction 2 is unobjectionable, the operation thus commencing with an elution with a class 2 solvent. The only exception to this general characteristic is the solvents of class 6, which in most cases elute fraction 6 only.

The invention, therefore, consists basically of the obtaining of Fractions 1+2,. 3, .4 and 5–9 by the procedure above summarized, with the option of applying a higher degree of resolution by performance of addition individual elutions where either feedstock nature or product demand suggest.

Concerning feedstock nature, we have already mentioned that the conditions or process by which it is derived from the primary carbonaceous material, such as whole coal, influence its composition. In Table 2 we identify some representative feeds, illustrating how their composition can vary.

Referring to Table II, it becomes clear that it could well be worthwhile to obtain Fraction 1 independently when dealing with a Synthoil feed; whereas in the case of the H-Coal feed commencing with a solvent from Class 2 is indicated in view of the small quantity of Fraction 1 present. Similarly, depending on the relative demand for Fractions 4 and 5, one may recover them separately (as, for instance, in the case of the high temperature Kentucky SRC where there is an unusually large 5-fraction) or as a mixture (as, for instance, in the case of the Synthoil where neither is present in notably large quantity). Again, the relatively small quantities of fractions 6–9 in the Synthoil might not justify their separate removal, whereas the large quantity of Fraction 9 in the high-temperature Kentucky SRC ( and the fairly large quantities of all of these fractions in the low-temperature Kentucky SRC) might well justify separate elutions of these fractions in those cases.

In general we prefer to apply individual fraction elution more in the case of Fractions 1 to 5 than in the case of Fractions 6 to 10. Fractions 1 to 5 show greater chemical differentiation between one another than Fractions 6 to 10, and include the phenols (particularly in fraction 4) which are, and long have been, a major economic reason for resolution of coal derivatives. Moreover, Fractions 6 to 10 will yield upon further processing about 80% of their weight in the form of good-quality char (eminently suitable for the manufacture of electrode coke) whereas Fractions 1 to 5 will furnish as char only about 20% of their weight. The sharp distinction between the elutions performed up to and including the use of a class 5 solvent, and those employing class 6 and subsequent solvents, is associated with the removal from the silica of its water, and the replacement of that water by the alcohol present in the class 5 solvent. In fact Fractions 1 to 5 are all benzene-soluble and collectively constitue the so-called "asphaltenes" clasically obtained by hot benzene extraction.

This alteration of the condition of the silica gel adsorbent during the sequence of elutions determines in part the unconventionality of the sequence of the eluants,

TABLE II

| Primary Material | ILLINOIS #6 COAL | | | KENTUCKY COAL | |
|---|---|---|---|---|---|
| Derivation Process | Synthoil | H-Coal | SRC | SRC (Short time, high temp.) | SRC (Long time, low temp.) |
| Wt. %, Fraction #1 | 25.08 | .06 | .78 | 1.10 | 2.97 |
| #2 | 18.70 | 6.20 | 2.49 | 3.50 | 15.32 |
| #3 | 30.18 | 40.50 | 26.35 | 11.20 | 31.32 |
| #4 | 6.79 | 9.30 | 9.63 | 5.60 | 9.92 |
| #5 | 5.57 | 12.50 | 11.84 | 16.20 | 8.83 |
| #6 | 3.06 | 5.40 | 3.97 | 11.40 | 5.43 |
| #7 | 2.13 | 7.60 | 14.28 | 5.90 | 9.21 |
| #8 | 3.28 | 8.50 | 13.95 | 9.80 | 7.63 |
| #9 | 4.47 | 7.60 | 15.19 | 32.40 | 9.30 |
| #10 | .73 | 2.40 | 1.52 | 2.80 | .08 |

(In addition to the variation in composition shown in the Table there can be significant variation in total yield based on coal: thus this yield was 46% for the first Kentucky derivative and 60% for the second).

and contributes to the unusual sharpness of resolution which the invention achieves, a sharpness most noticeable when the preferred eluants are employed in one or more of the sequential elutions. The preferred eluants, which are employed throughout the Examples which follow, are, for the respective classes:

| | |
|---|---|
| Class 1: | n-hexane |
| Class 2: | n-hexane/15% Wt. benzene |
| Class 3: | chloroform (freshly percolated over $Al_2O_3$) |
| Class 4: | chloroform/10% Wt. diethyl ether |
| Class 5: | diethylether/3% Wt. ethanol |
| Class 6: | methanol |
| Class 7: | chloroform/3% Wt. ethanol |
| Class 8: | tetrahydrofuran/3% Wt. ethanol |
| Class 9: | pyridine |
| Class 10: | pyridine/5% Wt. water |

In order that the invention may be more clearly understood the following Examples are provided by way of illustration of some of its preferred embodiments.

EXAMPLE 1

This Example is provided to illustrate the extreme sharpness of resolution obtainable by the method of the invention. 1 microliter of several laboratory-synthesised model solvent-refined coals was introduced into a chromatographic column containing 7cc of Woelm silica gel of 0.063 to 0.2 mm particle size and subjected to sequential elution by the specific preferred eluants above identified. The sharpness of resolution is apparent from the following chart of retention periods.

TABLE III

| Compound | | Retention Times* (sec.) |
|---|---|---|
| | Fraction 1 - Saturated Hydrocarbons | 240–1000 |
| a | Squalane | 246 |
| b | Cholestane | 288 |
| | Fraction 2- Aromatic Hydrocarbons | 1090–1690 |
| a | Octahydro anthracene | 864 |
| b | Dibenzothiophene | 1140 |
| c | 9,10-Dihydro phenanthrene | 1302 |
| d | Fluoranthene | 1308 |
| e | 3,5,-Di-(t-butyl)ethyl benzene | 1332 |
| f | 9-Benzilidene fluorene | 1560 |
| g | p-Terphenyl | 1590 |
| h | [2.2] Paracyclophane | 1704 |
| | Fraction 3 - Heterocyclics (Ethers and Non-Basic H) | 1690–2200 |
| a | Polyphenyl ether (6 ring) | 1758 |
| b | 2,3,4,5-Tetraphenyl pyrrole | 1770 |
| c | 1,2,3,4-Tetrahydro carbazole | 1878 |
| d | 2-Phenyl indole | 1932 |
| e | Xanthine | 2190 |
| | Fraction 4 - Simple Phenols | 2200–2820 |
| a | 2,3-Naphthalene diol | 2166 |
| b | 5-Hydroxy indole | 2394 |
| c | 2,6-Di(t-butyl)-p-cresol | 2424 |
| d | 5,6,7,8-Tetrahydro-1-Naphthol | 2430 |
| e | 4-Hydroxybenzothiophene | 2460 |
| f | Cholesterol | 2766 |
| | Fraction 5 - Basic Nitrogen and Di and Tri Functional Oxygen | 2820–3420 |
| a | Chrysin | 2862 |
| b | Julolidine | 2874 |
| c | N,N'-di-(2-naphthyl)-p-phenylene diamine | 2966 |
| d | Naphthoflavone | 3048 |
| e | Veratrine (mix of alkaloids)+ | 3180 |
| | Fraction 6 - Polyfunctional | 3420–4020 |
| a | Rutin | 3450 |
| | Fraction 7 - Polyfunctional | 4020–4560 |
| | Fraction 8 - Polyfunctional | 4560–5250 |
| | Fraction 9 - Polyfunctional | 5250–5820 |
| a | Veratrine (mix of alkaloids)++ | 5250 |
| | Phenolphthalein | 5610 |
| | Fraction 10 - Polyfunctional | 5820–6420 |

*Range given defines the position of the solvent fronts generated by SASC.
+Other components eluted in Fraction 9
++Other components eluted in Fraction 5

EXAMPLE 2

Three specimens of Wyodak solvent-refined coal, obtained under differing process conditions, were subjected to sequential elution employing the same chromatographic system and the same sequence of solvents as in Example 1. The yields expressed as the weight percentage each fraction represents of total material eluted, are set out in Table 4.

TABLE IV

| Fraction | Yield Wt. % | | |
|---|---|---|---|
| 1 | 2.2 | 1.4 | — |
| 2 | 11.6 | 8.3 | 7.6 |
| 3 | 10.2 | 18.2 | 20.8 |
| 4 | 4.6 | 26.7 | 20.0 |
| 5 | 26.1 | 13.7 | 10.4 |
| 6 | 8.8 | 3.9 | 4.3 |
| 7 | 9.0 | 3.9 | 4.4 |
| 8 | 10.9 | 11.9 | 15.8 |
| 9 | 11.8 | 11.9 | 13.9 |
| 10 | 4.7 | .3 | 2.3 |

Table V

| Fraction | Eluent | % in SRC | Elemental Analysis % C | % H | % O | % N | % S | MW |
|---|---|---|---|---|---|---|---|---|
| 1 | hexane | 0.4 | | | | | | |
| 2 | 15% benzene in hexane | 20 | | | | | | |
| 3 | $CHCl_3$ | 25 | 91.8 | 5.38 | 1.06 | 0.85 | 0.8 | 300 |
| 4 | $CHCl_3$/4% $Et_2O$ | 10.2 | 86.3 | 5.33 | 5.2 | 2.32 | 0.8 | 315 |
| 5 | $Et_2O$/3% EtOH | 10.1 | 87.6 | 5.35 | ~2 | 3.81 | 1.36 | 400 |
| 6 | methanol | 4.1 | 68.58 | 4.82 | 20.05 | 4.77 | 1.36 | — |
| 7 | $CHCl_3$/3% EtOH | 6.4 | 83.6 | 5.1 | 7.78 | 2.57 | 0.94 | 610 |
| 8 | THF/3% EtOH | 10.2 | 81.91 | 5.14 | 7.7 | 2.73 | 1.7 | 960 |
| 9 | pyridine | 8.5 | 83.7 | 4.5 | 8.3 | 2.51 | 0.9 | — |

As has been previously mentioned, an appreciable variation between relative proportions of the various fractions is caused by difference in derivation technique.

EXAMPLE 3

A further resolution, employing the same apparatus as in the previous Examples but omitting any elution with a Class 10 solvent, was performed on a solvent-refined Kentucky coal. The nine fractions obtained were subjected to elemental analysis and molecular weight determination to reveal their chemical differentiation from one another. The results of the run are set out in Table 5.

BRIEF DESCRIPTION OF THE DRAWINGS

We have devised an installation by which the method of the invention can be carried out on a continuous production basis. Continuity of the method is achieved by the use of more than one chromatographic column. Between successive sequences of elution of the on-stream column a reconditioning treatment, which may be steam-stripping or flushing with a highly polar solvent such as methanol, is applied to it to remove matter which might interfere with the following elution. The recondition is followed by evaporative removal of the methanol (where flushing is practised) and finally by rehydration to about 4% Wt. water content.

After the sequence of elutions prescribed by the invention has been performed a number of times there builds up in the column an accumulation of non-eluable material which interferes with effective sorption by the column of newly introduced batches of feed. When this point is is reached (and its occurrence will vary according to the nature of the feed being processed, but will usually be after 1–25 operations of the sequence) the silica gel is regenerated by oxidative combustion of the non-eluable accumulation, preferably at a temperature of about 200° to 400° C. After rehydration to about 4% Wt. water content (which must in any case be practised before re-use of the column) the column is again available for introduction of fresh feed.

Referring to the single FIGURE of the drawings, two silica gel chromatographic columns, 11 and 12 are employed. As shown, column 11 is being employed for elution from a batch of feed material sorbed on it of ten chemically differentiated fractions, separated at positions 1–10, whilst column 12, which has already been employed for sequential elution of about 20 such feed batches, is under regeneration.

For heating, for regeneration purposes, columns 11 and 12 are associated, respectively, with heating elements 13 and 14. At the point of operation shown in the drawing heating element 14 is actuated to bring the contents of column 12 to a temperature of about 325° C., and simultaneously air is being blown through that column from conduit 15 to combust non-eluable matter deposited in the column. Excess air and combustion products leave column 12 via conduit 16, which serves as heat imput to exchanger 17. Valving is provided to connect conduits 15 and 16 to column 11 instead of 12 when column 11 requires regeneration, at which point heating element 13 will be actuated instead of element 14.

Reverting, now, to the operation of column 11 a batch of coal liquid, obtained by processing of coal to obtain a derivative having the characteristics hereinabove set forth, is periodically supplied to the column from reservoir 18 via conduit 19 and directed to column 11 by valve 20.

When the batch of feed is sorbed on column 11, eluant is supplied to the column, via pump 21 and conduit 22, the valving **23*a* and 23*b* being arranged so that eluant can flow into column 11** only.

Removal of the successive feed fractions, each in solution in its appropriate eluant, occurs under the influence of gravity or pump pressure via conduit **24*a* (24*b* when column 12 is on stream) which is valved into conduit 24 which feeds into flash unit 25, the heat supply to which is derived from heat exchanged 17. Solvent vapour is removed under $CO_2$ pressure via outlet conduit 26, condensed in condenser 27, and returned by line 28** to its appropriate reservoir, the reservoir inlets being valved to ensure correct return.

Solvent depleted fractions leave flash unit 25 via conduit 29, and proceed via concentrator 30, line 31 and dryer 32 to recovery. Alternatively, fractions from unit 25 may exit via line 33 and undergo complete solvent removal in rotary dryer 34.

It will be understood that the installation can be modified to suit individual requirements. Thus, if less than 10 elutions are required by the particular product demand an appropriately smaller number of solvent reservoirs is needed. Further, the individual columns 11 and 12 can be replaced by banks of columns, fed via manifold from valves **23*a* and 23*b***, one bank being on stream while the other is under regeneration.

We claim:

1. A chromatographic method of resolving, into chemically differentiated fractions, such liquid derivatives of naturally occurring carbonaceous material as by virtue of their solvent-extractive or thermal derivation contain at least about 10% by weight asphaltenes and are substantially free of inorganic material, which method comprises the steps of:

(A) Introducing into a silica gel chromatographic column from about 5 to 20 percent, by weight of the silica in the column, of said derivatives;

(B) Successively eluting from the column fractions of said derivative by the sequential use, as eluant, of (i) a mixture of about 95 to 75 parts by weight of a saturate selected from petroleum ether, udex raffinate, alkylate, and pure hydrocarbons having 5 to 10 carbon atoms and a straight-chain, branched-chain or cyclic structure; with about 5 to 25 parts by weight of an aromatic selected from benzene, toluene, xylenes and mixtures of aromatics derived from a reforming, coking or cracking process;

(ii) Chloroform;

(iii) a mixture of about 98 to 80 percent by weight of chloroform with 2 to 20 percent by weight of an acyclic aliphatic ether having less than 10 carbon atoms; and (iv) an aromatic tertiary amine or a derivative thereof having a substituent selected from aliphatic hydrocarbon having 1 to 2 carbon atoms and cycloaliphatic having less than 7 carbon atoms; to obtain solutions in the respective eluants of four chemically differentiated fractions; and (C) Recovering each fraction from its solution in its eluant.

2. A method according to claim 1 wherein step (B) (i) is preceded by an elution from the column of a fraction of said derivative by the use of an eluant consisting of a saturate selected from petroleum ether, udex raffinate, alkylate, and pure hydrocarbons having 5 to 10 carbon atoms and a straight-chain, branched-chain or cyclic structure.

3. A method according to claim 2 wherein, after step (B) (iii) and before step B (iv), there is performed an elution from the column of a fraction of said derivative by the use, as eluant of (B) (iii) (a) a mixture of about 98 to 80 parts by weight of an acyclic aliphatic ether having less than 10 carbon atoms with about 2 to 20 parts by weight of an aliphatic alcohol containing from 1 to 4 carbon atoms.

4. A method according to claim 3 wherein, after step (B) (iii) (a) and before step (B) (iv), there is performed an elution from the column of a fraction of said derivative by the use, as eluant of (B) (iii) (b) an aliphatic alcohol containing 1 to 4 carbon atoms.

5. A method according to claim 4 wherein, after step (B) (iii) (b) and before step (B) (iv), there is performed an elution from the column of a fraction of said derivative by the use, as eluant, of (B) (iii) (c) a mixture of about 98 to 85 parts by weight of chloroform with about 2 to 15 parts by weight of an aliphatic alcohol containing 1 to 4 carbon atoms.

6. A method according to claim 5 wherein, after step (B) (iii) (c) and before step (B) (iv), there is performed an elution from the column of a fraction of said derivative by the use, as eluant, of (B) (iii) (d) a mixture of 100 to 85 parts by weight of a material selected from cyclic aliphatic ethers, tetrahydrofuran, dioxane and any of the foregoing bearing an aliphatic hydrocarbon substituent containing 1 to 4 carbon atoms with 0 to 15 parts by weight of an aliphatic alcohol containing 1 to 4 carbon atoms.

7. A method according to claim 1 wherein step (B) (iv) is succeeded by an elution from the column of a fraction of said derivative by the use, as eluant, of (B) (v) A mixture of about 95 to 85 parts by weight of the amine or derivative thereof defined in step (B) (iv) with about 5 to 15 parts by weight of water.

8. A method according to claim 1 wherein the eluants used are, in step (B) (i) a mixture of about 85 parts by weight of n-hexane and about 15 parts by weight of benzene; in step (B) (ii) chloroform freshly percolated over alumina; in step (B) (iii) a mixture of about 90 parts of chloroform and about 10 parts of diethylether; and, in step (B) (iv) pyridine.

9. A method according to claim 2 wherein said saturate is n-hexane.

10. A method according to claim 3 wherein the eluant used in step (B) (iii) (a) is a mixture of about 98 to 80 parts by weight of 97 parts by weight of diethyether with about 3 parts by weight of ethanol.

11. A method according to claim 4 wherein the eluant used in said step (B) (iii) (b) is methanol.

12. A method according to claim 5 wherein the eluant used in said step (B) (iii) (c) is a mixture of about 97 parts by weight of chloroform with about 3 parts by weight of ethanol.

13. A method according to claim 6 wherein the eluant used in said step (B) (iii) (d) is a mixture of about 97 parts by weight of tetrahydrofuran with about 3 parts by weight of ethanol.

14. A method according to claim 7 wherein said amine recited in step (B) (v) is pyridine.

15. A method according to claim 1 wherein said silica gel, before introduction thereinto of said derivative, comprises about 4 weight percent of water.

16. A method according to claim 15 wherein the weight ratio of silica gel to said introduced derivative is in the range of about 10:1 to 20:1.

17. A method according to claim 15 wherein the volume ratio of eluant to column capacity is, in the case of each elution, in the range of about 1:1 to 10:1.

18. A method according to claim 1 wherein said derivative is the entire product of the solvent refining of coal.

19. A method according to claim 18 wherein said product has a molecular weight extending over the range 300 to 1000.

20. A method according to claim 19 wherein said product consists to the extent of at least 50 percent by weight of asphaltenes.

21. A method according to claim 1 wherein said carbonaceous material is petroleum, tar sand or shale.

22. A method according to claim 1 wherein said derivative is the product of treatment of coal at elevated temperature in the presence of added hydrogen and/or carbon monoxide.

23. A process of resolving liquid solvent refined coal into ten fractions each comprising a plurality of functionally related compounds which comprises A introducing into a silica gel chromatographic column column about 1 part by weight of said solvent refined coal per 15 parts by weight of said silica;

(B) eluting fractions of said solvent refined coal from said column by the use, in sequence, as eluants, of (i) n-hexane, (ii) an about 85/15, by weight, n-hexane/benzene mixture, (iii) chloroform (iv) an about 90/10, by weight, chloroform/diethylether mixture, (v) an about 97/3, by weight, diethylether/ethanol mixture, (vi) methanol, (vii) an about 97/3, by weight, chloroform/ethanol mixture, (viii) an about 97/3, by weight, tetrahydrofuran/ethanol mixture.

(ix) pyridine, and (x) an about 95/5, by weight, pyridine/water mixture, each elution being substantially completed before a succeeding elution is commenced, to obtain solutions of each of said ten fractions in their respective eluants; and (C) recovering each fraction from solution in its eluant.

24. A process according to claim 23 wherein, after the sequence recited in step (B) has been performed a sufficient number of times to cause accumulation in said column of non-elutable material such material is removed therefrom by combustion at a temperature in the range 200° to 400° C.

25. A continuous process according to claim 23 wherein, during the performance of said steps (A) and (B) employing a first silica gel column, a second column containing an accumulation of non-eluable material derived from said solvent refined coal is regenerated by combustion of said material at a temperature of 200° to 400° C., said second column being substituted for the first when the regeneration is complete and the first column contains an accumulation of said non-elutable material.

26. A method according to claim 1 wherein said derivative, before introduction into said column, is subjected to solvent extraction to remove unwanted components.

27. A method according to claim 1 wherein, after each succession of elutions, the column is reconditioned by steam stripping.

28. A method according to claim 1 wherein, after each succession of elutions, the column is reconditioned by flushing with a highly polar solvent followed by removal of such flushing solvent by evaporation.

* * * * *